US007377143B2

(12) United States Patent
Wang

(10) Patent No.: US 7,377,143 B2
(45) Date of Patent: May 27, 2008

(54) DOOR LOCK WITH BUTTON STOPPER

(76) Inventor: Chien-chung Wang, No. 52, I-Hsin Rd., Chien-Cheng Pistrict, kaohsiung City (TW)

( * ) Notice: Subject to any disclaimer, the term of this patent is extended or adjusted under 35 U.S.C. 154(b) by 0 days.

(21) Appl. No.: 11/349,162

(22) Filed: Feb. 8, 2006

(65) Prior Publication Data

US 2007/0180874 A1 Aug. 9, 2007

(51) Int. Cl.
*E05B 13/10* (2006.01)
*E05B 55/04* (2006.01)

(52) U.S. Cl. ..... 70/224; 70/223; 70/467

(58) Field of Classification Search ..... 70/224, 70/220, 215–217, 467; 292/336.3
See application file for complete search history.

(56) References Cited

U.S. PATENT DOCUMENTS 3,011,331 A * 12/1961 Williams ..... 70/216
3,025,096 A * 3/1962 Williams ..... 292/359
5,941,108 A * 8/1999 Shen ..... 70/467
6,105,407 A * 8/2000 Yao ..... 70/472
6,575,006 B1 * 6/2003 Don ..... 70/472
6,615,630 B2 * 9/2003 Wu et al. ..... 70/472
2003/0193201 A1 * 10/2003 Hwang ..... 292/336.3

* cited by examiner

*Primary Examiner*—Patricia Engle
*Assistant Examiner*—Alyson M Merlino
(74) *Attorney, Agent, or Firm*—Troxell Law Office, PLLC

(57) ABSTRACT

A door lock able to be prevented from being locked by an unexpected exterior force includes a main body, a fixing member and a handle. The main body is provided with a sleeve at the center extended outwards from two sides. One end of the sleeve is matched with a lining tube that is linked with a button. Via rotating the button for an angle, projections of a stopper attached with one end of the button is to be guided into a blocking groove of the lining tube, enabling the button to be locked in the blocking groove so that the button can not be pressed down, able to prevent the button from being locked by an unexpected exterior force.

3 Claims, 6 Drawing Sheets

DOOR LOCK WITH BUTTON STOPPER

BACKGROUND OF THE INVENTION

1. Field of the Invention

This invention relates to a door lock, particularly to one able to prevent from being locked by an unexpected exterior force.

2. Description of the Prior Art

As shown in FIG. 1, a conventional door lock mainly includes a shell 10, a dragging mechanism 11 set inside the shell 10, a sleeve 13 extended axially from the shell 10, a set of driving tubes 14 in the sleeve 13 and a fixing member 15 set outside the sleeve 13.

The fixing member 15 is used to keep a door lock fixed on a door. Each driving tube 14 is connected with a L-shaped handle 16 at one end, which is able to drive the driving tube 14 to spin against the sleeve 13 axially while the handle 16 is turned, so that the dragging mechanism 11 in the shell 10 is drawn back. One of the driving tubes 14 is fixed with a button 17 provided with an extending body 170 at one end and provided with a sliding groove 140 at an outer annular rim. The sliding groove 140 communicated with an insert groove 141 at its one end can let the button 17 move along it axially. When the button 17 is pressed down, the extending body 170 is to slide along the sliding groove 140 to enter the insert groove 141, keeping the button 17 locked, unable to open the door lock.

But, the extending body 170 of the button 17 in the conventional door lock is very easy to be guided into the locking groove 141 by an unexpected exterior force. Therefore, when a door is opened, the button 17 sometime is casually pressed by an exterior force, such as an impact of the door against a wall, to make it locked. If such a door with the lock kept in the locked condition is pushed or pulled to close unintendedly, a person may be locked outside the door, unable to open it.

SUMMARY OF THE INVENTION

The objective of this invention is to offer a door lock able to prevent itself from being locked by an unexpected exterior force.

The characteristics of the invention are a main body, a fixing member and a handle. The main body is provided with a sleeve at the center extended outwards from two sides. One end of the sleeve is matched with a lining tube that is set with a button inside it. One end of the button is connected with a stopper that is provided with projections extended from the outer annular rim. The lining tube is provided with a guiding groove at a proper preset location able to be fitted with the projections of the stopper, a blocking groove at one end adjacent to the guiding groove and a locking groove at the end of the guiding groove.

The fixing member is provided with a first disc and a second disc. The first disc is provided with a hole and the second disc is provided with a hole. The first disc and the second disc can be fitted on the sleeve via penetrating through the holes of the first disc and the second disc respectively.

The handle is provided with a buttonhole at one end and a matching hole at the other end. The matching hole is matched with the lining tube of the main body. The buttonhole is fitted with the button.

BRIEF DESCRIPTION OF DRAWINGS

This invention is better understood by referring to the accompanying drawings, wherein.

DETAILED DESCRIPTION OF THE PREFERRED EMBODIMENT

Figure 1:
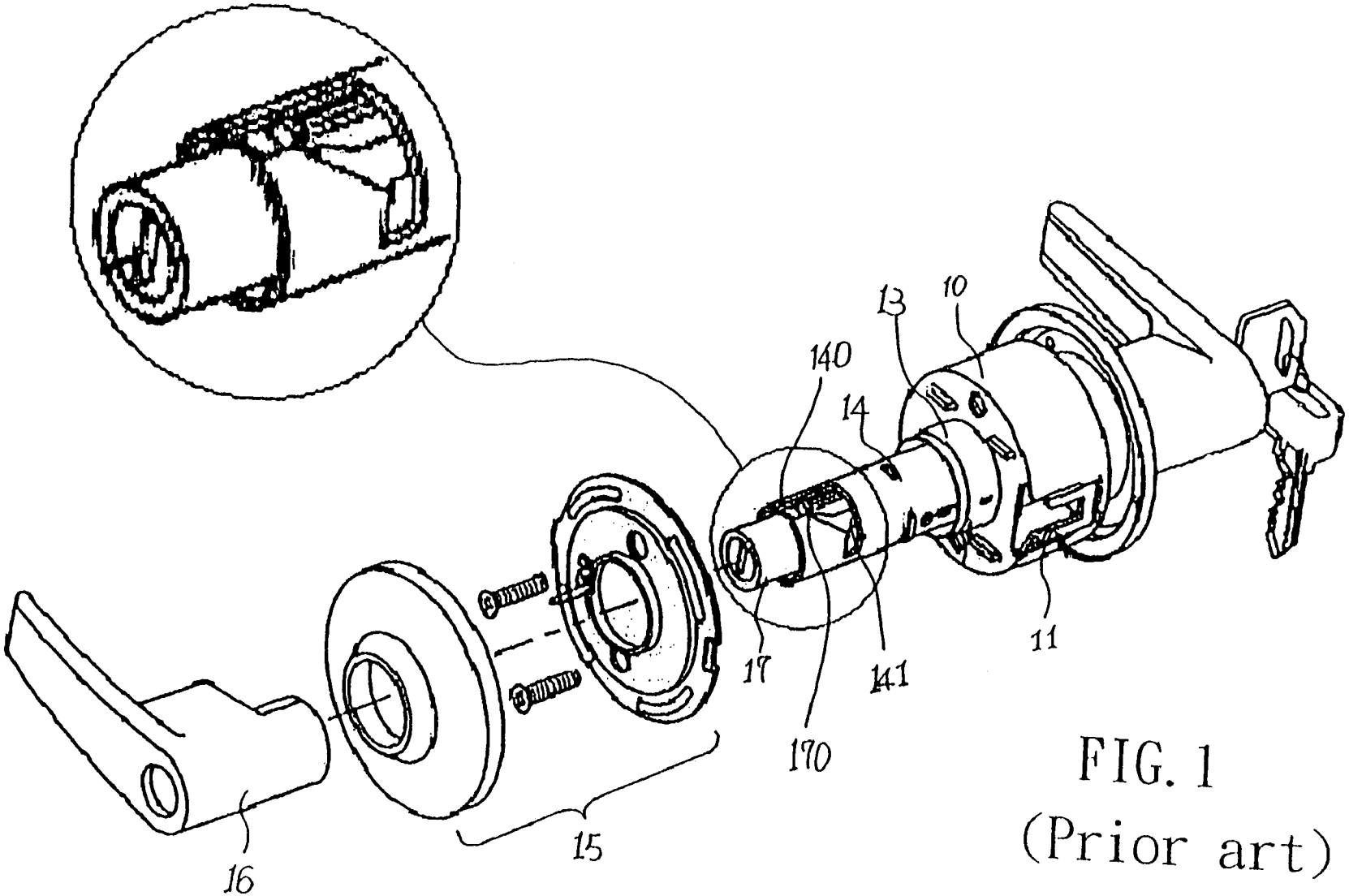
FIG. 1 (Prior art)
FIG. 1 is an exploded perspective view of a conventional door lock.
Figure 2:
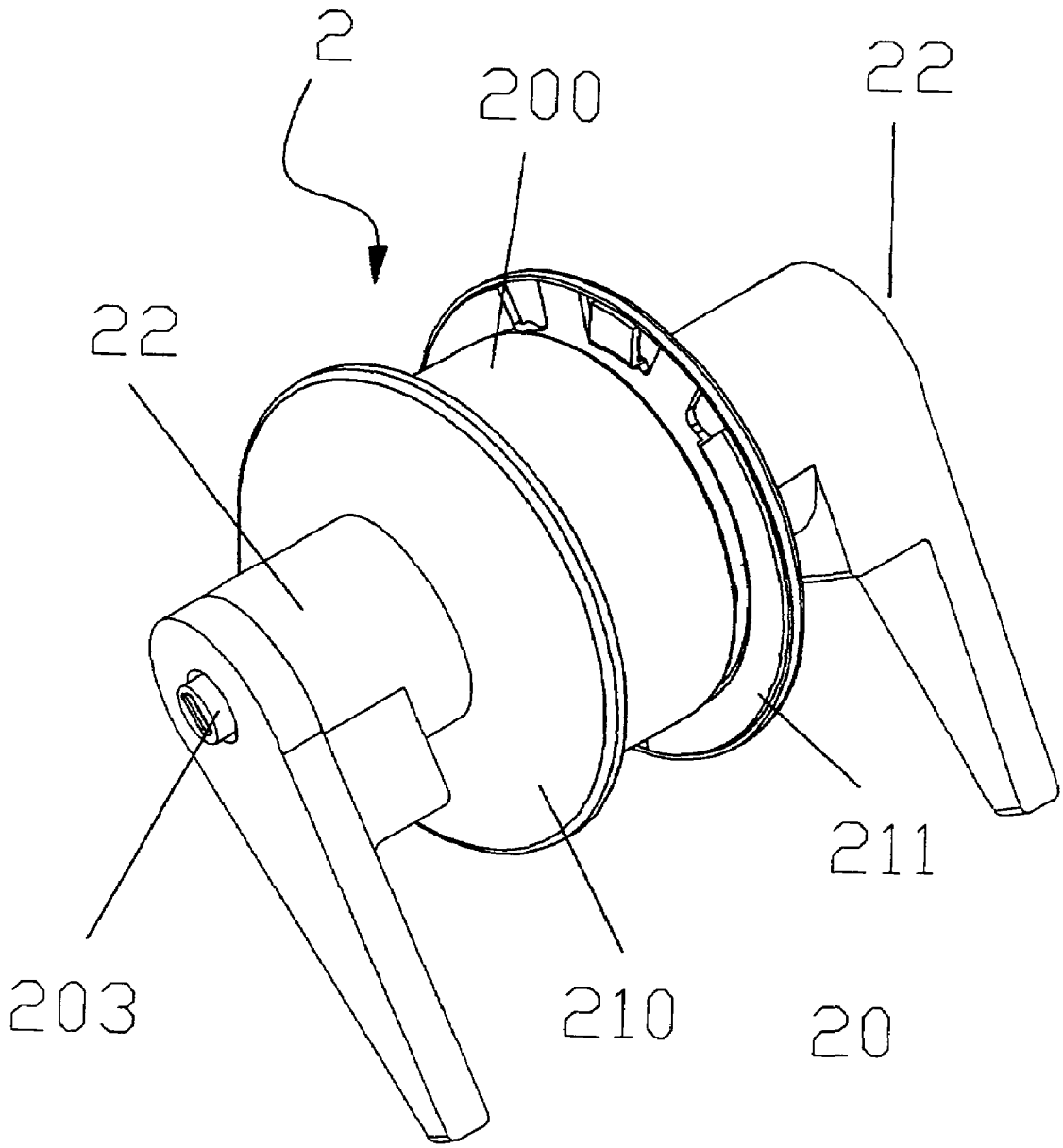
FIG. 2 is a perspective view of a first preferred embodiment of a door lock in the present invention.
Figure 3:
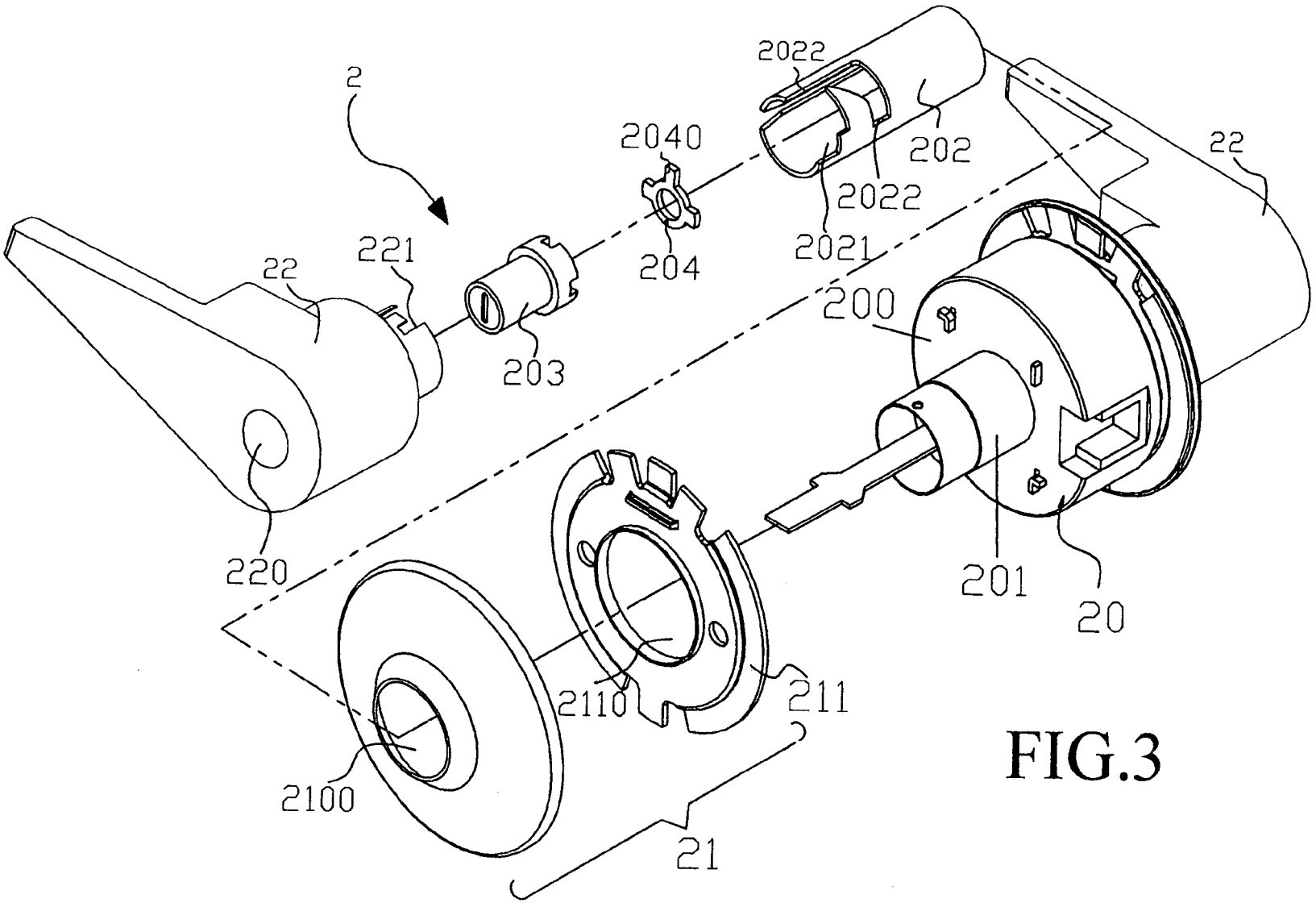
FIG. 3 is a partial exploded perspective view of the first preferred embodiment of a door lock in the present invention.
Figure 4:
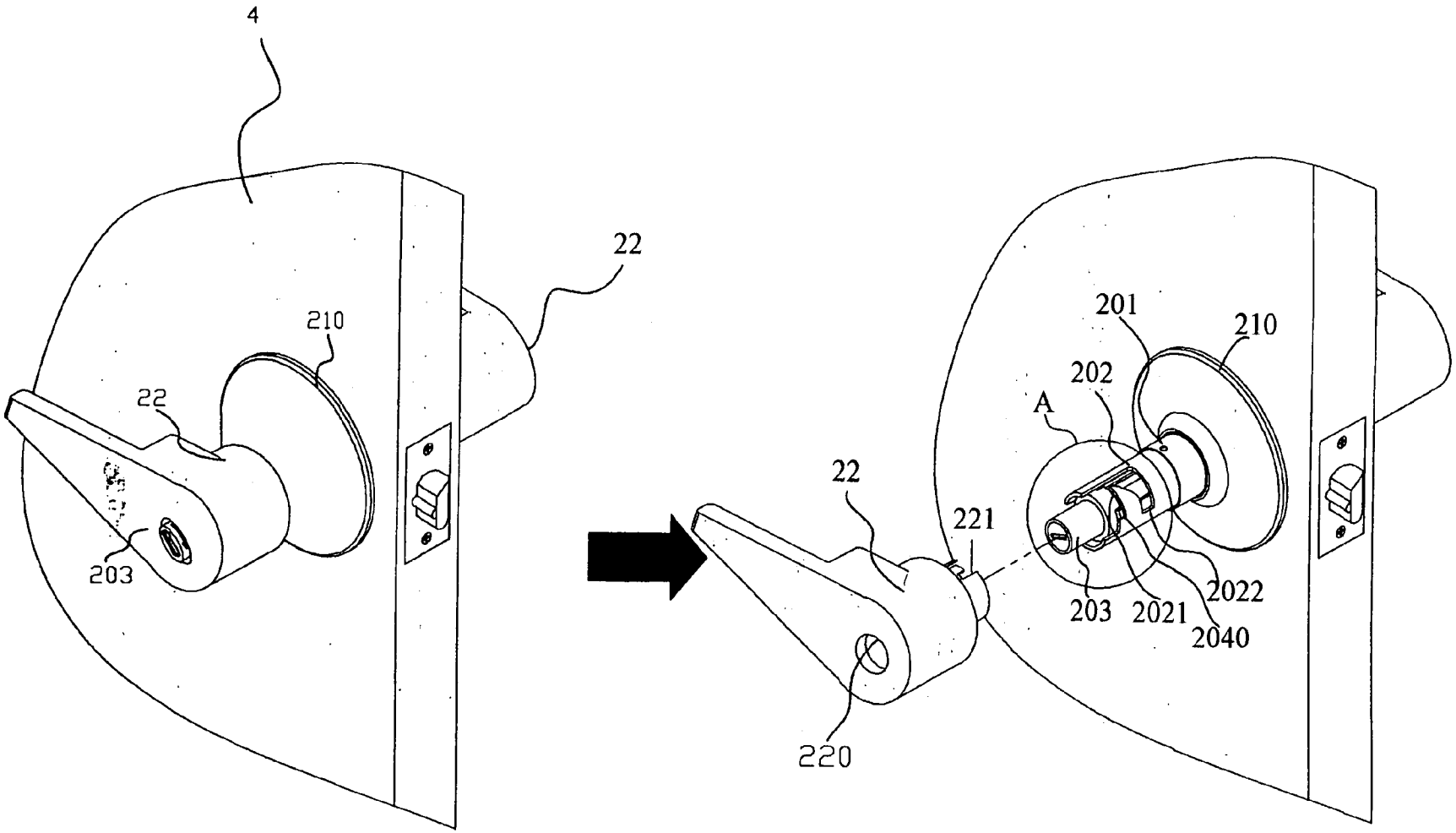
FIG. 4 is another perspective and exploded view of the first preferred embodiment of a door lock in the present invention.
Figure 5:
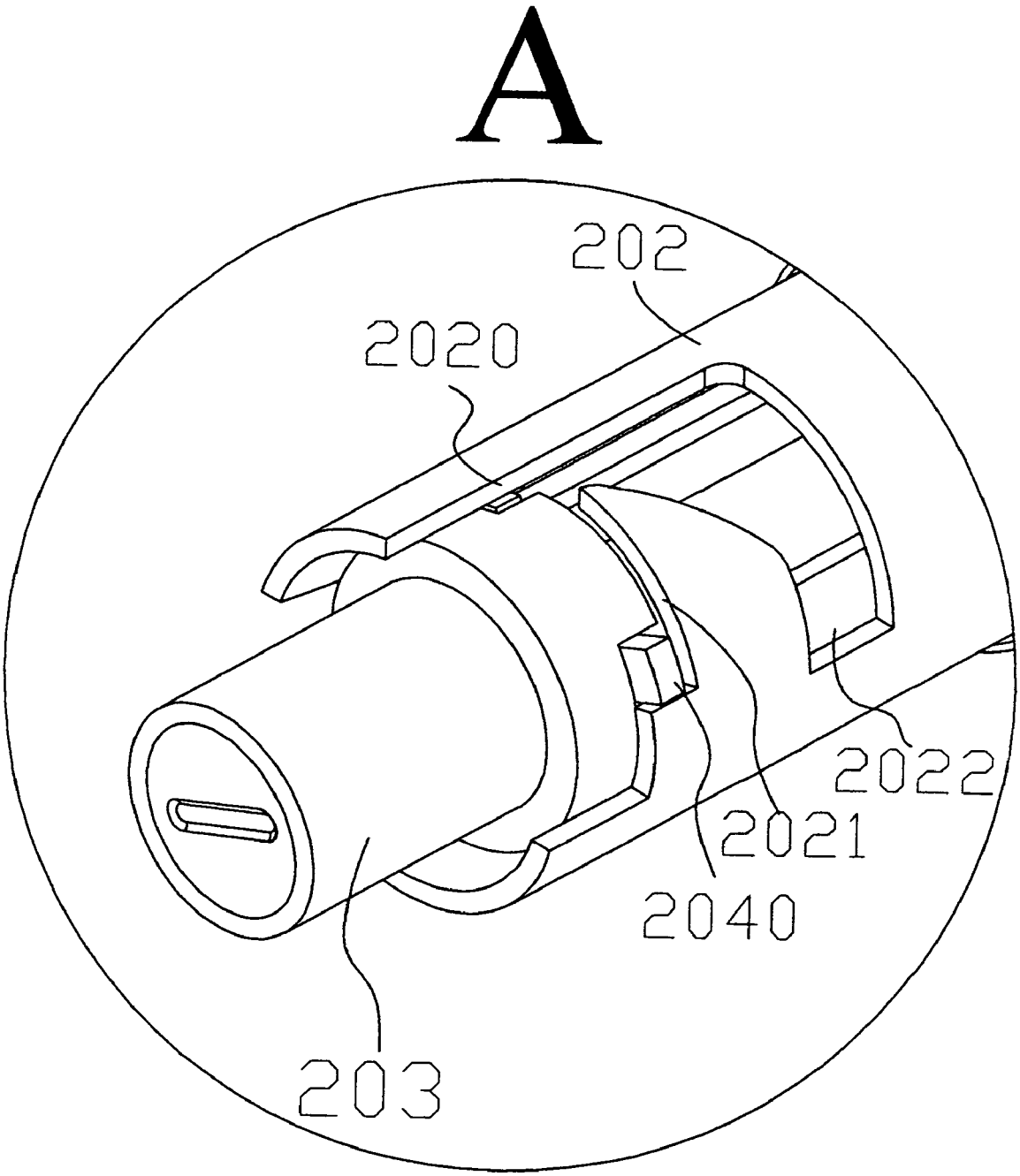
FIG. 5 is a magnified view of the part marked (A) in FIG. 4.
Figure 6:
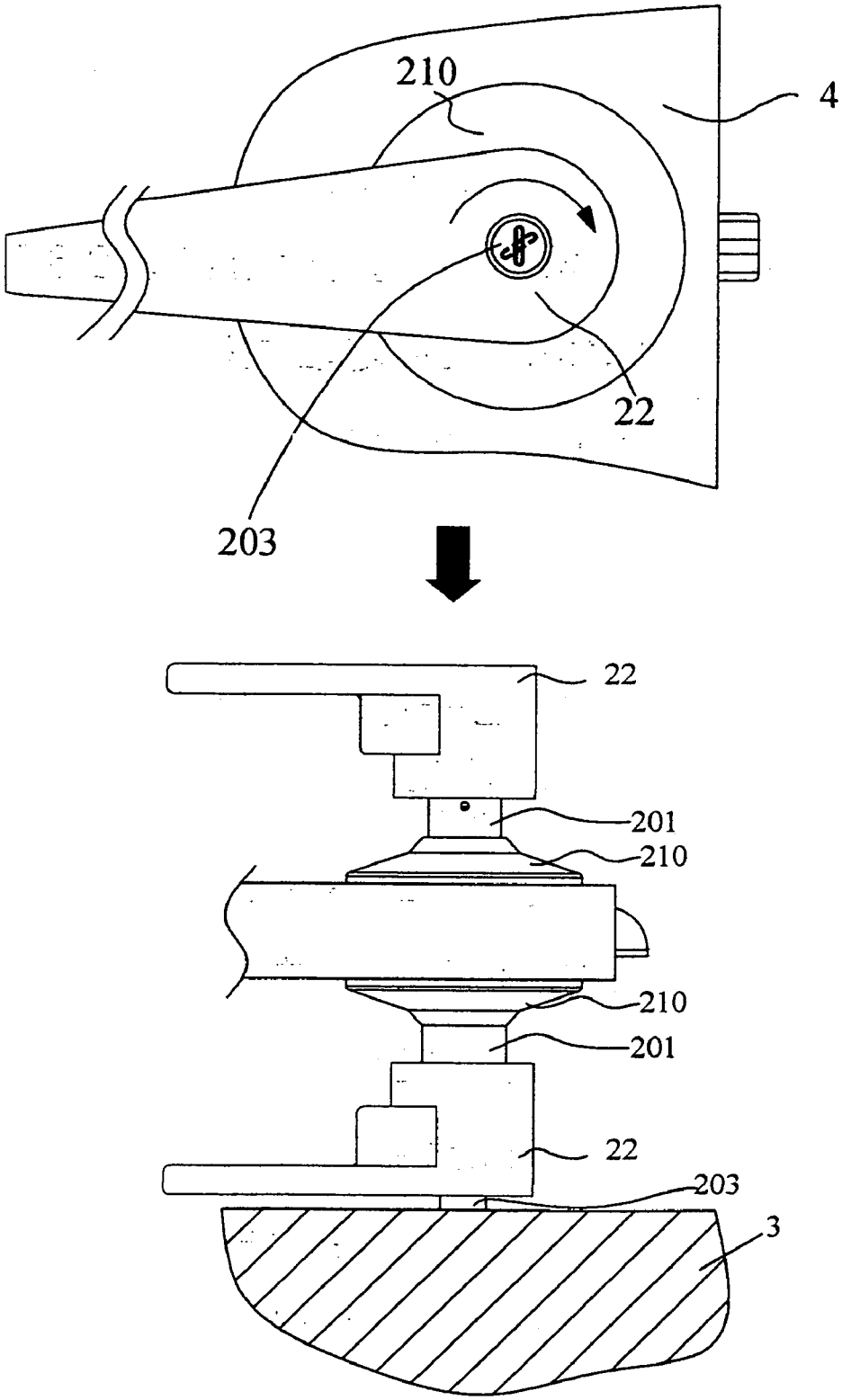
FIG. 6 is an upper view of a second preferred embodiment of a door lock in the present invention.

As shown in FIGS. 2-6, a first preferred embodiment of a door lock 2 in the present invention includes a main body 20, a fixing member 21 and a handle 22.

The main body 20 is provided with a driving member 200 in an intermediate portion, which is assembled with a sleeve 201 respectively at two sides. A lining tube 202 inserted into one side of the sleeve 201 is set with a button 203 inside it. The button 203 is connected with a stopper 204 that is provided with plural projections 2040 extended from the outer annular rim. The lining tube 202 is provided with a guiding groove 2020 at a proper preset location able to be fitted with the projections 2040 of the stopper 204, a blocking groove 2021 at one end adjacent to the guiding groove 2020 and a locking groove 2022 at the end of the guiding groove 2020. In order to prevent the door lock from being locked by an unexpected exterior force, the button 203 can be spun to an angle axially to enable the projections 2040 of the stopper 204 linked with the button 203 to rotate axially to enter into the blocking groove 2021. If the door lock is to be always locked up, a user can press down the button 203 to enable the projections 2040 of the stopper 204 to rotate axially while moving through the guiding groove 2020 to enter the locking groove 2022.

The fixing member 21 is provided with a first disc 210 and a second disc 211. The first disc 210 is provided with a hole 2100 and the second disc 211 is provided with a hole 2110. The first disc 210 and the second disc 211 can be fitted on the sleeve 201 via penetrating through the holes 2100 and 2110.

The handle 22 is provided with a buttonhole 220 at one end and a matching hole 221 at the other end. The matching hole 221 is matched with the lining tube 202 of the main body 20. The buttonhole 220 is fitted with the button 203.

In using, when the button 203 is spun axially for an angle, the projections 2040 of the stopper 204 linked with the button 203, can also be rotated axially to enter into the blocking groove 2021, able to keep the button 203 from being pressed down. Therefore, such a button 203 of the door lock in the present invention cannot be pressed down by any unexpected exterior force, such as an impact of the door against a wall, preventing a user from being locked outside the door.

The invention has the following advantages as can be seen from the foresaid description.

1. Effective prevention of unintended locking: Because the projections 2040 of the stopping piece 204 is linked with the button 203, they can be guided into the blocking groove 2021, keeping the button 203 unable to be pressed down, preventing a user from being locked outside a door by any unexpected exterior force.

2. Easy positioning: The button 203 has only to be spun for an angle to enable the projections 2040 of the stopper 204 to enter the blocking groove 2021 or moving through the guiding groove 2022 into the locking groove 2022, therefore, it is easy to fix or lock up and able to prevent the door lock from being locked by an unexpected exterior force and achieve an anti-theft effect.

3. More exact positioning: The door lock of the invention will never be locked up unintendedly when it should not be, so a user does not have to worry about what to do if he should be locked outside a door.

While the preferred embodiment of the invention has been described above, it will be recognized and understood that various modifications may be made therein and the appended claims are intended to cover all such modifications that may fall within the spirit and scope of the invention.

What is claimed is:

1. A door lock comprising:

a main body provided with a driving member in an intermediate portion assembled with a sleeve respectively at two sides, said sleeve is inserted through said intermediate portion and has a lining tube located on one end thereof, a button located inside the sleeve and movable between first and second button positions, said button linked with a stopper at one end, said stopper provided with a plurality of projections around the outer annular rim, said lining tube provided with a guiding groove at a proper preset portion, said lining tube has a blocking groove located at a first end of said guiding groove and a locking groove located at a second end of said guiding groove, said plurality of projections of said stopping piece selectively sliding within said guiding groove;

a fixing member provided with a first disc and a second disc, said first disc provided with a hole, said second disc provided with a hole, said first disc and said second disc able to be fitted on said sleeve of said main body via penetrating through said hole of said first disc and said hole of said second disc; and a handle provided with a button hole at one end and a matching hole at the other end, said matching hole matched with the lining tube of said main body, said button hole fitted with said button, wherein the plurality of projections are selectively rotated and movable between first, second, and third projection positions, wherein, when the plurality of projections are located in the first projection position, at least one of the plurality of projections is located in the blocking groove, the blocking groove limiting a movement of the at least one projection of the plurality of projections and the button, the button is located in the first button position extending outwardly from the lining tube, wherein, when the plurality of projections are located in the second projection position, the at least one projection of the plurality of projections is slidably located in the guiding groove allowing the button to be moved between the first button position and the second button position, and wherein, when the at least one projection of the plurality of projections is located in the third projection position, the at least one projection of the plurality of projections is located in the locking groove, the locking groove limiting a movement of at least one projection of the plurality of projections and the button, the button is located in the second button position depressed inwardly into the lining tube.

2. A door lock as claimed in claim 1, wherein said plurality of projections of said stopper are to be guided into said blocking groove.

3. A door lock as claimed in claim 1, wherein the guiding groove, the blocking groove and the locking groove are located on a same side of the sleeve.

* * * * *